United States Patent [19]

Kotzin, Jr.

[11] 4,074,918

[45] Feb. 21, 1978

[54] CHAIR AND DETACHABLE LOCKER

[76] Inventor: Bernard Kotzin, Jr., 7411 Flight Ave., Los Angeles, Calif. 90045

[21] Appl. No.: 777,969

[22] Filed: Mar. 16, 1977

[51] Int. Cl.[2] ..... A47C 7/62

[52] U.S. Cl. ..... 297/192; 220/19; 292/259

[58] Field of Search ..... 297/189, 192, 193, 217; 292/257; 70/94, 77, 158, 58; D30/14; 232/41 A; 211/126, 181; 119/17; 220/18, 19, 210, 243, 244, 249; 312/117

[56] References Cited

U.S. PATENT DOCUMENTS

| | | | |
|---|---|---|---|
| 1,849,505 | 3/1932 | Ondrasik, Jr. | 220/19 |
| 2,210,347 | 8/1940 | Story | 297/192 X |
| 2,264,744 | 12/1941 | Dunham | 297/192 X |
| 2,911,133 | 11/1959 | Ruggieri | 220/19 X |
| 2,973,807 | 3/1961 | Close | 297/192 |
| 3,232,686 | 2/1966 | Syler | 297/192 |
| 3,584,915 | 6/1971 | Meyers, Jr. | 297/192 |
| 3,665,736 | 5/1972 | Wilson | 292/259 |
| 3,945,227 | 3/1976 | Reiland | 70/58 |

*Primary Examiner*—James T. McCall
*Attorney, Agent, or Firm*—Edward D. O'Brian

[57] ABSTRACT

A locker serving as an article support or container adapted to be utilized with a conventional chair can be constructed so as to include a bottom, a top, two side walls, a closed end, an open end, and a door pivotally mounted on the top so as to be capable of being pivoted about a horizontal axis so as to close off the open end. A locking arm structure is pivotally mounted on the bottom adjacent to the closed end. The locker is capable of being inserted between the legs of the chair beneath the seat of the chair and above a member such as a brace forming a part of the chair in such a position that it is supported by the member. The locking arm can be pivoted beneath the member to a position in which an end of it is located adjacent to the door when the door is closed. Securing means such as "U" shaped loops are provided on the locking arm and on the door for use in securing the door against movement and the locker in place beneath the chair.

5 Claims, 4 Drawing Figures

CHAIR AND DETACHABLE LOCKER

BACKGROUND OF THE INVENTION

The invention set forth in this specification pertains to the combination of a chair and a detachable article support or locker which can be installed on the chair in such a manner that it cannot be removed from the chair.

It will, of course, be recognized that it is old to locate article supports beneath chairs. Many different types of chairs have been constructed so as to include a shelf or shelf-like structure as an integral part of a chair beneath the seat of such a chair. It is also known to construct various types of shelves or article supports in such a manner that they can be hooked on to existing chairs. In spite of this it is considered that there is a need for new and improved article supports which can be utilized with existing chairs. More specifically it is considered that there is a need for lockers which can be utilized with and secured to existing chairs.

The reasons why it is believed that such a need exists can be illustrated with reference to the use of chairs in the garment industry. In this industry most employees sit on chairs and perform various different operations. In such industry it has been customary to provide these employees with lockers located at locations remote from where such employees work. Because of the areas where lockers have been located being away from normal or relatively constant activity in a plant they are frequently unobserved. As a result they are vulnerable to theft.

It is considered that it would be much more desirable to have such lockers where they can be observed by employees during the normal working activities and where they can be conveniently observed by other employees even when a specific employee is temporarily absent from his or her normal work location. Space requirements normally make it impossible to locate lockers of conventional design in such a location. Normally the space beneath a chair is not utilized.

SUMMARY OF THE INVENTION

An objective of the present invention is to provide new and improved article supports or lockers which can be utilized in combination with chairs such as are conventionally used in various types of manufacturing operations. A related object of the invention is to provide lockers which are adapted to be installed beneath the seat of such a chair in such a manner as to avoid taking up shelf or floor space such as would be required if completely separate lockers were used adjacent to such chairs. A further objective of the invention is to provide lockers as described which may be easily and conveniently manufactured at a nominal cost and which may be easily and conveniently installed beneath the seats of existing chairs. Further objectives of the invention is to provide lockers as indicated which may be easily and conveniently used.

In accordance with this invention these and various related objectives of the invention are achieved by providing in the combination of a chair and an article support located beneath the seat of the chair the improvement which comprises: the article support consisting of an elongated locker having a door providing access to the interior of said locker, the article support being located beneath the seat and between the legs of the chair so that the door is accessible, at least one member secured to the chair and extending beneath the bottom of the locker, a locking arm structure pivotally mounted on the locker remote from the open end and fitting around the member, and cooperating securing means for use in securing the door and the locking arm means to one another so as to prevent removal of the locker from the chair and so as to prevent the door from being opened when the securing means are secured to one another.

BRIEF DESCRIPTION OF THE DRAWING

Because of the nature of the present invention it is best more fully described with reference to the accompanying drawing in which.

Figure 1:
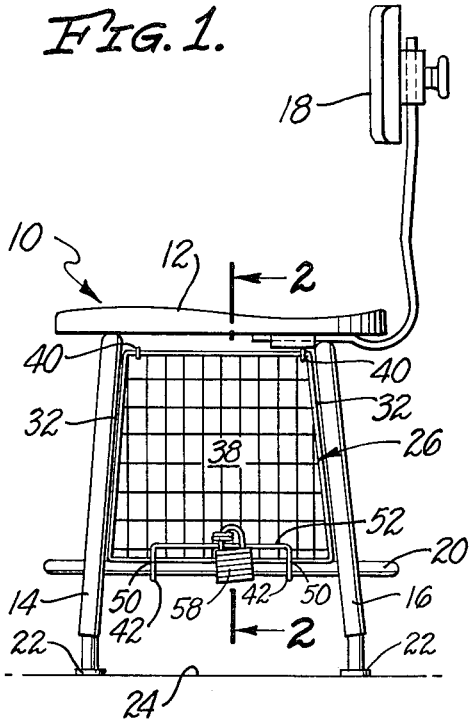
FIG. 1 is a side elevational view of a chair with an article support or locker in accordance with this invention installed on the chair.
Figure 3:
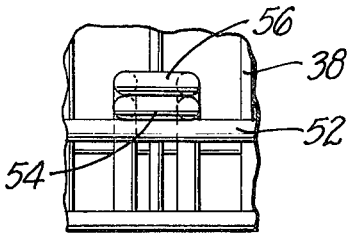
FIG. 3 is a fragmentary view at an enlarged scale illustrating the positions of securing means employed when a padlock is not being used to secure them together.
Figure 4:
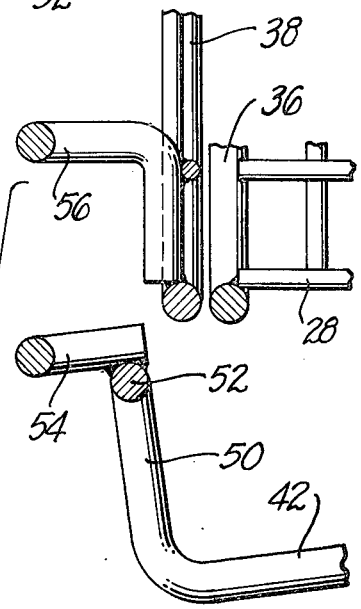
FIG. 4 is a partial cross-sectional view at an enlarged scale indicating how such securing means come together during the installation and/or use of a structure as illustrated in the preceding figures.
Figure 2:
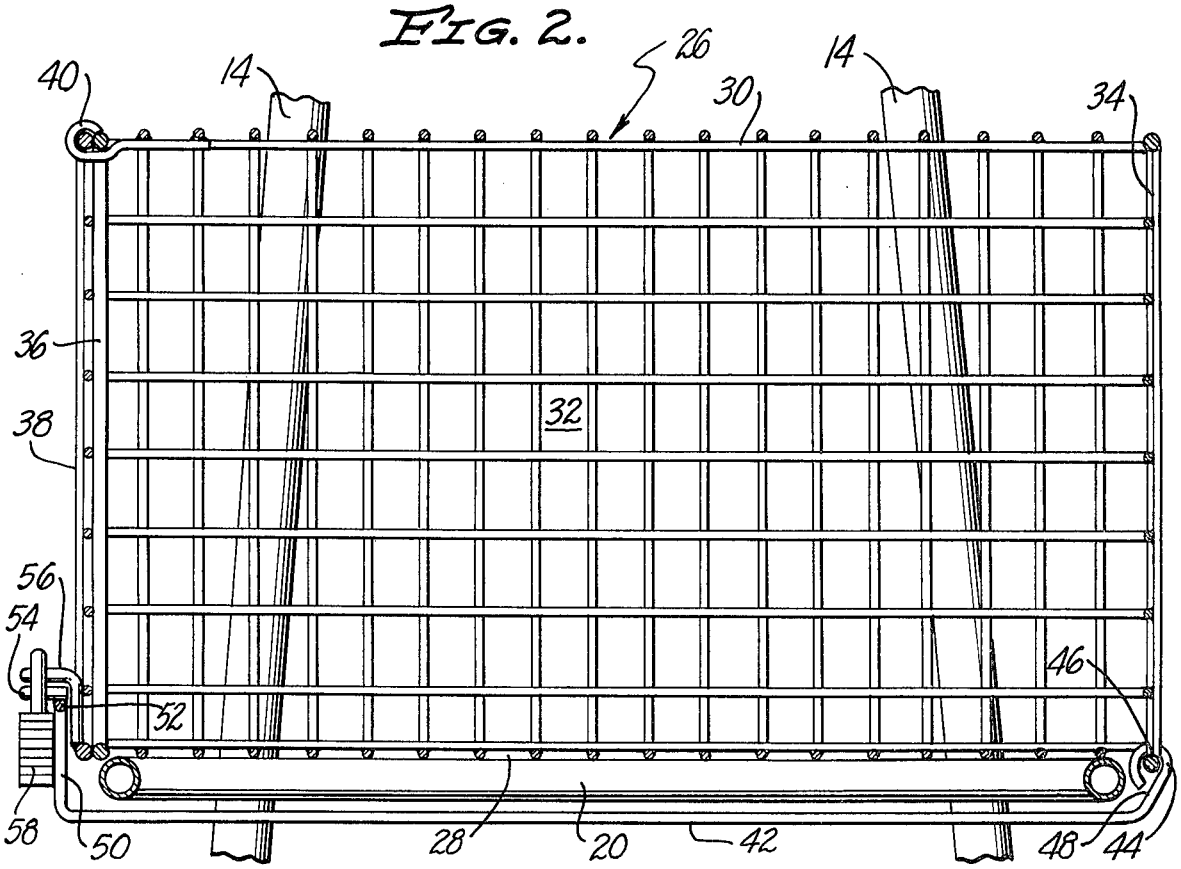
FIG. 2 is a cross-sectional view at an enlarged scale taken at line 2—2 of FIG. 1.

It will be understood that the present invention is not limited to chairs and/or lockers constructed exactly as shown in the drawing. The principles and concepts of this invention as set forth and defined in the appended claims can be easily utilized with a variety of different chairs and a variety of differently constructed lockers through the use or exercise of routine engineering skill.

DETAILED DESCRIPTION OF THE PREFERRED EMBODIMENT

In the drawing there is shown a conventional chair 10 which is constructed so as to include a seat 12, a set of two front legs 14, a set of two back legs 16, and a conventional seat back 18. It will be realized that only one of the front legs 14 and that only one of the back legs 16 are illustrated in FIG. 1. The individual front legs 14 and the individual back legs 16 are spaced apart in accordance with conventional practice.

The particular chair 10 illustrated also includes a member 20 which is secured to and which extends between the front legs 14 and the back legs 16 so as to be located intermediate the seat 12 and the ends 22 of the legs 14 and 16 which are adapted to rest upon a supporting surface such as a floor 24. The particular member 20 illustrated is a continuous member which is attached to all four of the legs 14 and 16 and which is adapted to be utilized as a foot rest with the chair 10. It will be realized that other different braces or the like extending between a front leg 14 and a back leg 16 can be used as the member 20.

This chair 10 is used in combination with an article support or locker 26 formed in a conventional manner by welding rods or wires (not separately numbered) together. The locker 26 includes a bottom 28, a top 30, two side walls 32 connecting the bottom 28 and the top 30, a closed end 34 extending between the bottom 28, the top 30 and the walls 32 and an open end 36. A door 38 is mounted by cooperating conventional wire pivots 40 for rotation about a horizontal axis (not separately numbered) so that it can be rotated between a closed position as shown in which this door 38 blocks access to the interior of the locker 26 through the open end 36 by generally extending from the top 30 to the bottom 28 and between the side walls 32.

Two locking arms 42 are pivotally mounted by conventional wire pivots 44 along the edge 46 between the bottom 28 and the closed end 34. These arms 42 have downwardly extending first ends 48 adjacent to the edge 46 and upwardly extending second ends 50 so that they will accommodate the member 20 in such a manner that the arms 42 will extend around this member 20 in order to secure the locker 26 against removal from the chair 10. The ends 50 are connected by a cross-member 52 so as to connect the arms 42 into a unitary structure (not separately numbered).

A small "U" shaped loop 54 is located on the cross-member 52. A corresponding "U" shaped loop 56 is located on the door 38 in such a position that the two loops 54 and 56 are located adjacent to one another when the door 38 is in a closed position and when the arms 43 extend closely adjacent to the member 20. These loops 54 and 56 may be referred to as cooperating securing means since they are adapted to be utilized with a conventional padlock 58 in holding the door 38 shut and in holding the arms 42 in such a manner that the locker 26 is both locked closed and is secured against movement relative to the chair 10. Obviously other known securing means such as, for example, a conventional key-actuated latch set can be substituted for the loops 54 and 56 and the padlock 58.

A combined chair 10 and locker 26 structure as described in the preceding is considered to be significantly advantageous for many purposes. The structure described enables an employer to provide employees with lockers in a work area where such lockers can be constantly observed. This is accomplished in accordance with the present invention through the utilization of what is essentially waste space— the space under a chair seat. The use of the invention does not require the utilization of floor space for lockers. Further, it locates lockers where they can be most conveniently utilized.

I claim:

1. In the combination of a chair having four legs which are spaced from one another, a seat supported by the legs, and an article support located beneath said seat of said chair the improvement which comprises:

said article support consisting of an elongated locker having a top, a bottom, two side walls, a closed end, an open end, and a door capable of being manipulated between open and closed positions located at said open end for providing access to the interior of said locker and for closing off the interior of said locker, said article support being located beneath said seat and between said legs of said chair so that one of said side walls is adjacent to a set of two of said legs and the other of said side walls is adjacent to a set consisting of the other two of said legs and being located so that said door is accessible, at least one member secured to said chair and extending between said sets of legs beneath the bottom of said locker, a locking arm means having first and second ends, said first end being pivotally mounted on said locker remote from said open end and fitting around said member so that said second end is located in proximity to said door, and cooperating securing means on said arm structure and on said door for use in securing said door and said locking arm means to one another so as to prevent removal of said locker from said chair and so as to prevent said door from being opened when said securing means are secured to one another.

2. The combination claimed in claim 1 in which:

said door is pivotally mounted on said top adjacent to said open end so as to be capable of pivoting about a horizontal axis, said locking arm means is pivotally mounted on said locker adjacent to one end of said body, said securing means on said door and on said locking arm means are located adjacent to said bottom of said locker.

3. The combination claimed in claim 1 wherein:

said securing means comprise loops which are aligned with one another and which are adapted to receive a padlock when said door is in said closed position and said locking arm means is fitted around said member.

4. The combination claimed in claim 1 wherein:

said locker is supported on said member.

5. The combination claimed in claim 1 wherein:

said door is pivotally mounted on said top adjacent to said open end so as to be capable of pivoting about a horizontal axis, said locking arm means is pivotally mounted on said locker adjacent to one end of said body, said securing means on said door and on said locking arm means are located adjacent to said bottom of said locker, said securing means comprise loops which are aligned with one another and which are adapted to receive a padlock when said door is in said closed position and said locking arm means is fitted around said member, and said locker is supported on said member.

* * * * *